US012114760B2

(12) United States Patent
Zhao

(10) Patent No.: US 12,114,760 B2
(45) Date of Patent: Oct. 15, 2024

(54) TWO-WAY ADJUSTABLE SHOCK-ABSORBING BACKPACK

(71) Applicant: Li Zhao, Guangdong (CN)

(72) Inventor: Li Zhao, Guangdong (CN)

( * ) Notice: Subject to any disclaimer, the term of this patent is extended or adjusted under 35 U.S.C. 154(b) by 148 days.

(21) Appl. No.: 18/073,074

(22) Filed: Dec. 1, 2022

(65) Prior Publication Data

US 2024/0130510 A1 Apr. 25, 2024
US 2024/0225245 A9 Jul. 11, 2024

(30) Foreign Application Priority Data

Oct. 19, 2022 (CN) ..... 202211279450.X
Oct. 19, 2022 (CN) ..... 202222751689.4

(51) Int. Cl.
*A45F 3/04* (2006.01)
*A45F 3/12* (2006.01)

(52) U.S. Cl.
CPC ..... *A45F 3/047* (2013.01); *A45F 3/12* (2013.01); *A45F 2003/045* (2013.01); *A45F 2003/122* (2013.01)

(58) Field of Classification Search
CPC ..... A45F 3/047
USPC ..... 224/631
See application file for complete search history.

(56) References Cited

U.S. PATENT DOCUMENTS 5,090,604 A * 2/1992 Howe ..... A45F 3/04 224/641
7,152,771 B2 * 12/2006 Le Gal ..... A45F 3/047 224/636
7,232,048 B2 * 6/2007 Le Gal ..... A45F 3/08 224/634
7,946,460 B2 * 5/2011 Yip ..... A45F 3/047 224/631
8,240,531 B2 * 8/2012 Lam ..... A45F 3/04 224/644
9,060,590 B2 * 6/2015 Valesko ..... A45F 3/08
10,849,409 B2 * 12/2020 Moncreiff ..... A45F 3/08
2021/0100339 A1 * 4/2021 Moncreiff ..... A45F 3/047

FOREIGN PATENT DOCUMENTS

CN 215125225 U * 12/2021

* cited by examiner

*Primary Examiner* — Justin M Larson

(57) ABSTRACT

The invention discloses a two-way adjustable shock-absorbing backpack, comprising a backpack main body and back pads arranged on one side of the backpack main body, wherein the back pads are provided two, and the two are symmetrically arranged on the backpack main body, a back pad pocket with a top opening is formed between the back pad and the backpack main body, a support fabric bag is sewn into the back pad pocket, and a support rod is inserted into the inside of the support fabric bag, one side of the backpack main body above the support fabric bag is provided with a fixed fabric belt, in the invention, by adjusting the length of the secondary braces on the upper adjustment button, the shock-absorption adjustment of the top of the backpack is realized, by adjusting the lower adjustment button, the shock-absorbing stroke adjustment of the elastic band is realized.

10 Claims, 7 Drawing Sheets

TWO-WAY ADJUSTABLE SHOCK-ABSORBING BACKPACK

1. TECHNICAL FIELD

The invention relates to the technical field of backpack, in particular to a two-way adjustable shock-absorbing backpack.

2. BACKGROUND ART

Backpack is a tool used to carry items in daily life, which can store items together for easy portability, and double shoulder braces can help people carry more easily, backpack is a necessary tool in daily life, which is not only simple in structure, and easy to operate.

When people hike, travel, commute or perform sports training with backpacks, people's walking basically likes an inverted pendulum, and the backpack follows the human body to reciprocate up and down in the vertical direction. In the prior art, the braces of the backpack are all fixed, and there is no room for buffering, people wear the backpack for a long time, the braces are pressed and tightened under the human body for a long time, which is easy to cause shoulder strain, and the fit between the braces and the back of the human body is soft and cannot form support, resulting in discomfort.

In order to reduce the force exerted on the shoulder by the up-and-down motion of the backpack during the human body's movement, in the invention with publication number of CN215125225U, a shoulder strap independent shock-absorbing backpack is disclosed, wherein a covering cloth is arranged on one side of a strap, an S-shaped reinforcing strip is arranged in the covering cloth, rigid connection at the joint is changed into elastic connection through a first elastic band and a second elastic band, the weight of two shoulder straps can be distributed in a balanced manner when the backpack is carried on the back, and the effects of damping and reducing load are achieved when the backpack is used, the telescopic length of the second elastic band is limited through the rigid limiting band, the second elastic band is prevented from exceeding the elastic limit, the durability of the second elastic band is guaranteed, the rigid limiting band 4 slides along the first limiting groove, the shoulder strap is prevented from swinging left and right, the strap slides along the second limiting groove, the stability is further improved, and the back of the human body is more fitted through the S-shaped reinforcing strip, and the supporting force of the back panel is increased, thereby conforming to ergonomics and being more comfortable. The two shoulder straps are respectively provided with an independent elastic body, and the lengths of the two shoulder straps can be automatically adjusted according to the use conditions such as stooping and leaning to one side, thereby the two straps are always wrapped on the shoulders and cannot slip off.

However, although the shock-absorbing backpack can reduce the force exerted by the backpack on the shoulders of the human body to a certain extent through the elastic belt, the shock-absorbing backpack cannot adjust the degree of shock absorption, when the quality of the bag changes, or when the movement range of the person changes, the vertical amplitude of the backpack cannot be actively adjusted, and can only be adjusted passively by the elasticity of the elastic belt, thereby the shock absorption effect will be greatly reduced, and greatly reducing the comfort of the backpack.

In addition, in the process of using the above shock-absorbing backpack, the back is not supported, which is easy to cause the backpack to bend and not fit the back when worn, the force of the backpack is not vertical, which is easy to collide with the buttocks or waist of the bearer, and the vertical shock absorption effect is reduced, which makes the backpack uncomfortable and affects the use experience.

3. SUMMARY OF THE INVENTION

The invention aims to provide a two-way adjustable shock-absorbing backpack, to solve the problems that the existing backpack shock absorption degree cannot be adjusted and the back support is insufficient as proposed in the background technology.

To achieve the above object, the invention provides the following technical schemes: a two-way adjustable shock-absorbing backpack, comprising a backpack main body and back pads arranged on one side of the backpack main body, wherein the back pads are provided two, and the two are symmetrically arranged on the backpack main body, a back pad pocket with a top opening is formed between the back pad and the backpack main body, a support fabric bag is sewn into the back pad pocket, and a support rod is inserted into the inside of the support fabric bag, one side of the backpack main body above the support fabric bag is provided with a fixed fabric belt, a fixed sleeve for accommodating the top end of the support rod is sewn on the bottom of the fixed fabric belt, and an elastic braces is sewn on the bottom end of the support fabric bag on the backpack main body, one end of the elastic braces is sewn with a main braces, one end of the main braces is sewn with a secondary braces, the upper half of the secondary braces is provided with an upper adjustment button, and the lower half thereof is provided with a lower adjustment button, one side of the secondary braces under the lower adjustment button is sewn with an elastic band, one end of the elastic band is sewn with a buckle, and a hanging sleeve is sewn on both sides of the bottom of the backpack main body.

Preferably, an adjustment band is provided on one side of the fixed fabric belt away from the fixed sleeve, one end of the adjustment band is provided with a male buckle, the outer wall of the support fabric bag is sewn with a fixed band, and one end of the fixed band is sewn with a female buckle.

Preferably, the middle of the secondary braces is sewn and fixed on the main braces, the top of the secondary braces is sewn with the fixed fabric belt, a triangular connection cloth is sewn on both sides of the bottom of the backpack main body, the bottom end of the secondary braces is sewn with the triangular connection cloth, and the hanging sleeve is sewn with the triangular connection cloth.

Preferably, a first strap and a second strap are sewn on the main braces outside the secondary braces, and the first strap is arranged above the second strap.

Preferably, the secondary braces outside the elastic band is sleeved with an elastic girdle, the distance from seam part of the secondary braces and the elastic band to the bottom of the secondary braces is greater than the length of the elastic band.

Preferably, a fixed female buckle is provided on top outer wall of the support fabric bag, and a fixed male buckle matched with the fixed female buckle is provided on one side of the bottom of the fixed fabric belt.

Preferably, the support rod comprises: two rod bodies, a double-ended sleeve is arranged between the two rod bodies, the rod bodies are hollow rods, an elastic string is inserted through each of the rod bodies, and both ends of the elastic string are provided with spacing knots on the outside of the end of the rod body, and one end of the rod body away from the double-ended sleeve is provided with a plug, and the top of the plug has a spherical transition.

Preferably, the rod bodies are made of carbon fiber.

Preferably, the buckle is tri-glide buckle, an opening for hanging the hanging sleeves is provided on one side of the buckle close to the hanging sleeve, the corners of the buckle are rounded.

Preferably, the bottom end of the elastic braces and the bottom end of the support fabric bag are sewn together with the bottom side of the backpack main body.

Compared to the prior art, the advantageous effects of the invention are as follows:

By providing the elastic braces, elastic band and buckle, the invention realizes that when the two-way adjustable shock-absorbing backpack is used, the elastic stroke of the elastic braces is limited by the length of the secondary braces, when the backpack is in static state, the elastic braces and the main braces are under force, and the upper half of the secondary braces is in a free and unstressed state, when the backpack is in dynamic state, the elastic braces are stretched and stretched until the secondary straps are stressed, and the backpack is supported by the force of the secondary braces and the main braces, by adjusting the length of the secondary braces on the upper adjustment button, the length of the upper half of the secondary braces can be adjusted, thereby the elastic stroke of the elastic braces can be adjusted, when the length of the upper half of the secondary braces becomes longer, the elastic deformation of the elastic braces is large, and the shock absorption amplitude is large, whereas, when the length of the upper half of the secondary braces becomes shorter, the elastic deformation of the elastic braces is small, and the shock absorption amplitude is small, and above realizes the shock absorption adjustment of the top of the backpack.

When it is necessary to adjust the shock absorption of the bottom of the backpack, hanging the buckle on the hanging sleeve, the elastic band is stressed to support the backpack, and the elastic deformation of the elastic band absorbs the shock of the backpack, by adjusting the lower adjustment button, the length of the lower half of the secondary braces is adjusted to limit the amount of elastic deformation of the elastic band, when the elastic band is deformed to the point where the secondary braces is stressed, the deformation stops, thereby realizing the shock-absorbing stroke adjustment of the elastic band, and realizing the shock-absorbing adjustment of the bottom of the backpack.

By arranging support fabric bag, support rod and fixed fabric belt, the invention realizes that when the two-way adjustable shock-absorbing backpack is used, by inserting the support rod into the support fabric bag, the end of the support rod is covered by the fixed sleeve on the fixed fabric belt, and the fixed fabric belt is locked by the cooperation of the fixed female buckle and the fixed male buckle, thereby realizing the fixing of the support rod, the support rod is locked twice by the cooperation of the female buckle and the male buckle, and the back of the backpack is supported by the support rod to prevent the backpack from bending during the carrying process, to make the backpack fits the back and realize the vertical shock-absorbing of the backpack, which has a good shock absorption effect, and can avoid the collision between the backpack and the human body, thereby improving the comfort of the backpack.

4. BRIEF DESCRIPTION OF THE DRAWINGS

In the accompanying drawings: 1—backpack main body; 101—triangular connection cloth; 2 back pads; 3—main braces; 301—first strap; 302—second strap; 4—secondary braces; 401—elastic girdle; 5—elastic band; 6—support fabric bag; 601—fixed female buckle; 7—support rod; 701—rod body; 702—plug; 703—double-ended sleeve; 704—elastic string; 8—fixed fabric belt; 801—fixed male buckle; 9—a fixed sleeve; 10—hook; 11—hanging sleeves; 12—lower adjustment button; 13 upper adjustment button; 14—elastic braces; 15—male buckle; 16—adjustment band; 17—female buckle; 18—fixed band.

5. DETAILED DESCRIPTION OF THE PREFERRED EMBODIMENTS

The technical schemes in the embodiments of the invention will be clearly and completely described below with reference to the accompanying drawings in the embodiments of the invention, obviously, the described embodiments are only a part of the embodiments of the invention, but not all of the embodiments.

Figure 1:
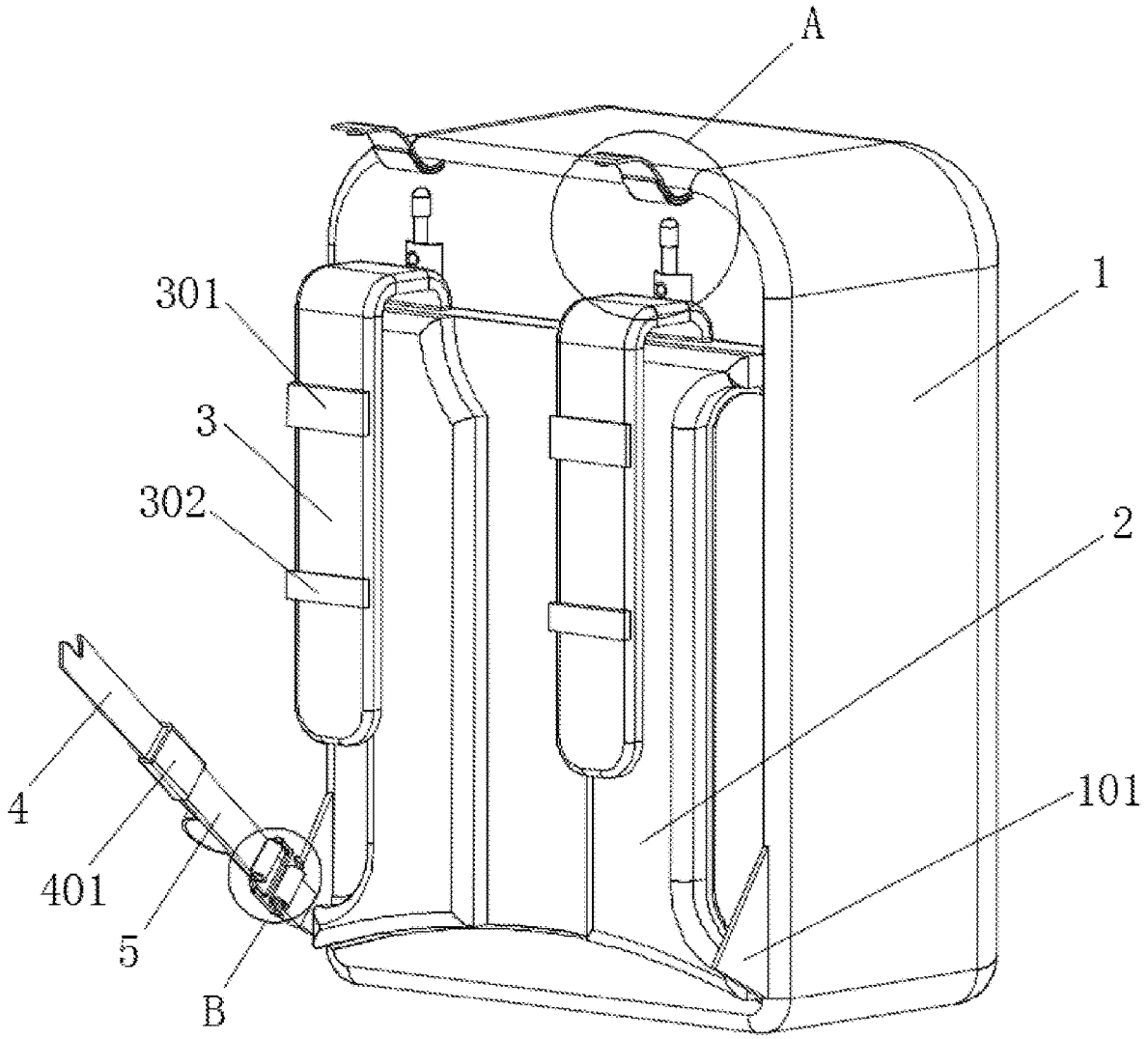
FIG. 1 shows a perspective view of a two-way adjustable shock-absorbing backpack in the invention.
Figure 2:
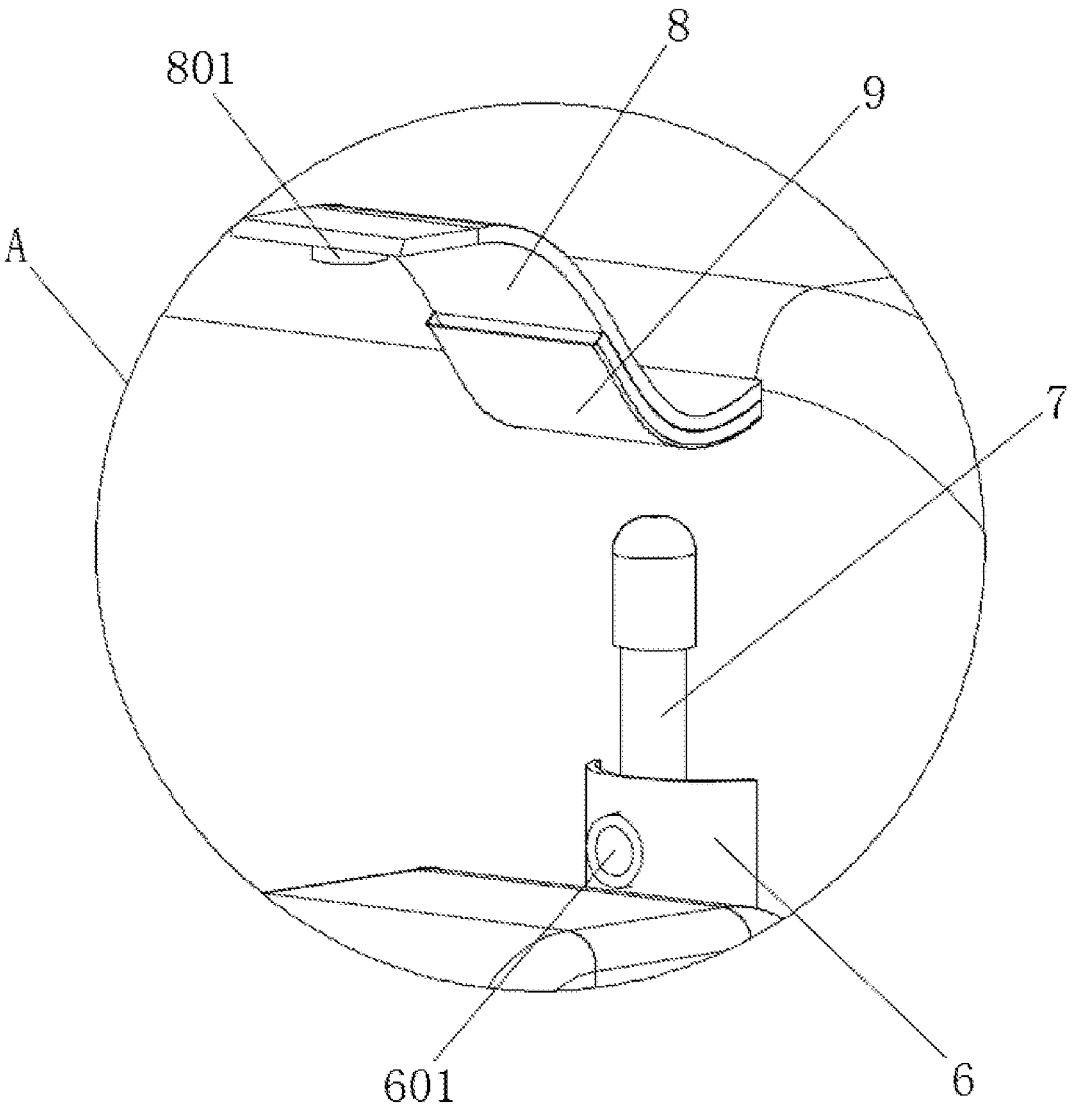
FIG. 2 shows enlarged structure at A in FIG. 1.
Figure 3:
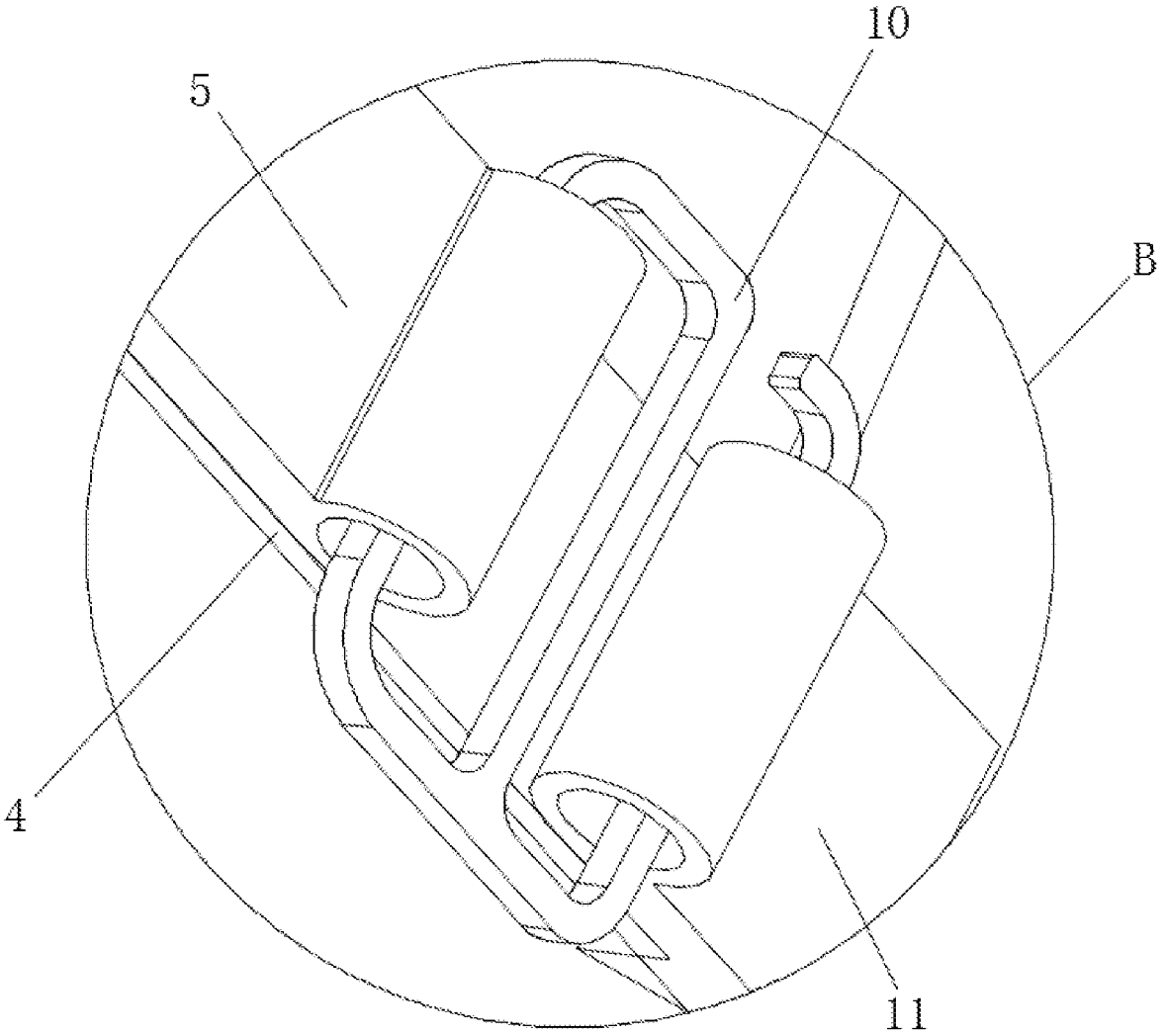
FIG. 3 shows enlarged structure at B in FIG. 1.
Figure 4:
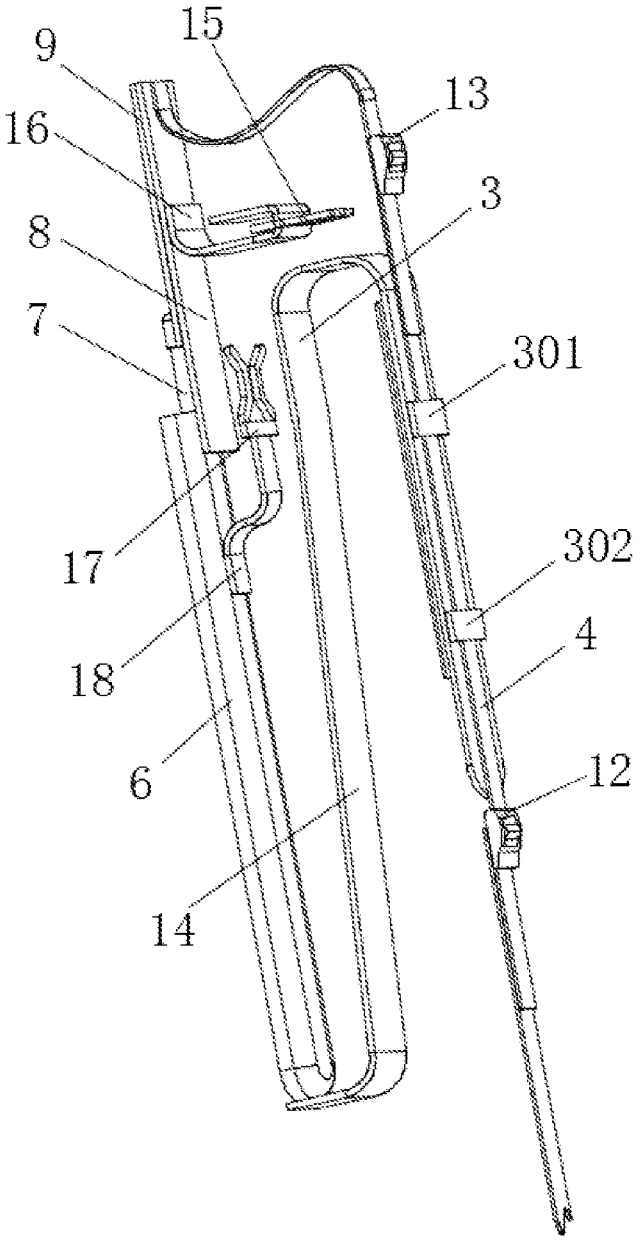
FIG. 4 shows connection structure of the main braces of a two-way adjustable shock-absorbing backpack in the invention.
Figure 5:
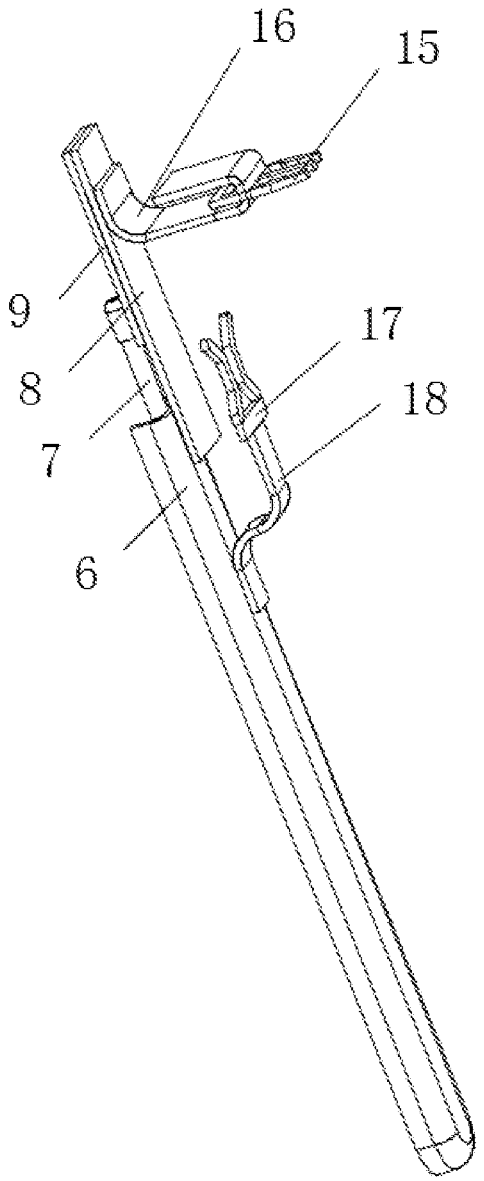
FIG. 5 shows connection structure of the support fabric bag of a two-way adjustable shock-absorbing backpack in the invention.
Figure 6:
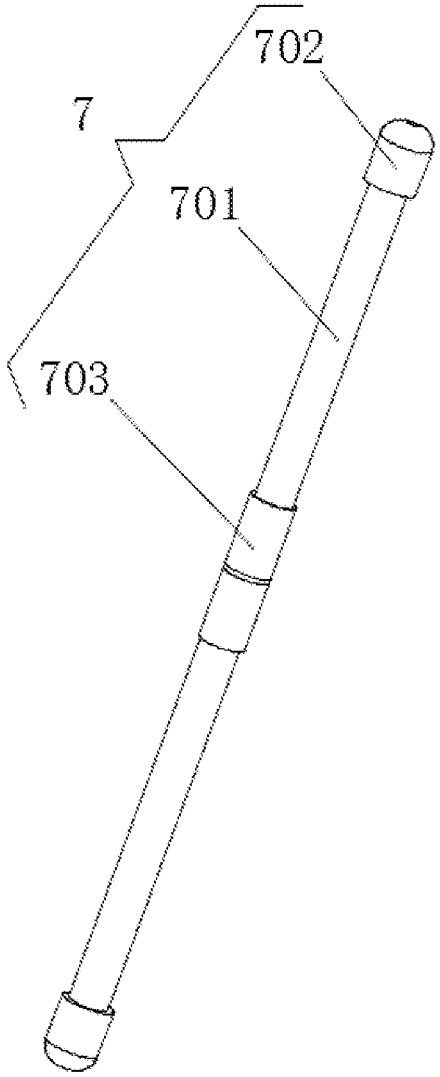
FIG. 6 shows connection state of the support rod of a two-way adjustable shock-absorbing backpack in the invention.
Figure 7:
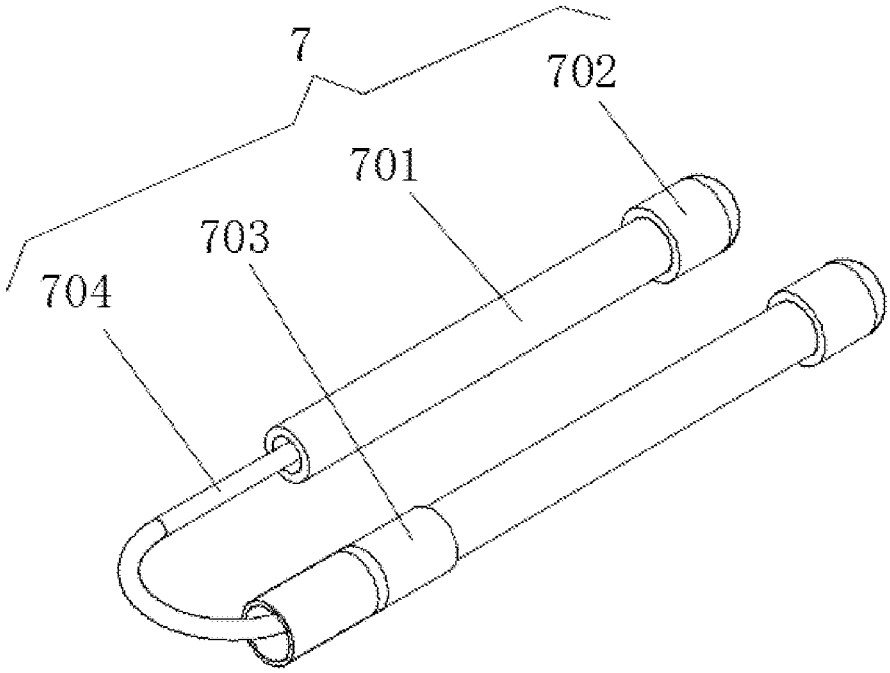
FIG. 7 shows folding state of the support rod of a two-way adjustable shock-absorbing backpack in the invention.

As shown in FIG. 1-7, the invention provides a two-way adjustable shock-absorbing backpack, comprising a backpack main body 1 and back pads 2 arranged on one side of the backpack main body 1, wherein the back pads 2 are provided two, and the two are symmetrically arranged on the backpack main body 1, a back pad pocket with a top opening is formed between the back pad 2 and the backpack main body 1, a support fabric bag 6 is sewn into the back pad pocket, and a support rod 7 is inserted into the inside of the support fabric bag 6, one side of the backpack main body 1 above the support fabric bag 6 is provided with a fixed fabric belt 8, a fixed sleeve 9 for accommodating the top end of the support rod 7 is sewn on the bottom of the fixed fabric belt 8, and an elastic braces 14 is sewn on the bottom end of the support fabric bag 6 on the backpack main body 1, one end of the elastic braces 14 is sewn with a main braces 3, one end of the main braces 3 is sewn with a secondary braces 4, the upper half of the secondary braces 4 is provided with an upper adjustment button 13, when the backpack is in static state, the elastic braces 14 and the main braces 3 are under force to support the backpack, and the upper half of the secondary braces 4 is in a free and unstressed state, when the backpack is in dynamic state, the elastic braces 14 are stretched and stretched until the secondary straps 4 are stressed, and the backpack is supported by the force of the secondary braces 4 and the main braces 3, by adjusting the length of the secondary braces 4 on the upper adjustment button 13, the length of the upper half of the secondary braces 4 can be adjusted, thereby the elastic stroke of the elastic braces 14 can be adjusted, when the length of the upper half of the secondary braces 4 becomes longer, the elastic deformation of the elastic braces 14 is large, and the shock absorption amplitude is large, whereas, when the length of the upper half of the secondary braces 4 becomes shorter, the elastic deformation of the elastic braces 14 is small, and the shock absorption amplitude is small, and above realizes the shock absorption adjustment of the top of the backpack.

The lower half thereof is provided with a lower adjustment button 12, one side of the secondary braces 4 under the lower adjustment button 12 is sewn with an elastic band 5, one end of the elastic band 5 is sewn with a buckle 10, and a hanging sleeve 11 is sewn on both sides of the bottom of the backpack main body 1. When it is necessary to adjust the shock absorption of the bottom of the backpack, hanging the buckle 10 on the hanging sleeve 11, the elastic band 5 is stressed to support the backpack, and the elastic deformation of the elastic band 5 absorbs the shock of the backpack, by adjusting the lower adjustment button 12, the length of the lower half of the secondary braces 4 is adjusted to limit the amount of elastic deformation of the elastic band 5, when the elastic band 5 is deformed to the point where the secondary braces 4 is stressed, the deformation stops, thereby realizing the shock-absorbing stroke adjustment of the elastic band 5, and realizing the shock-absorbing adjustment of the bottom of the backpack.

An adjustment band 16 is provided on one side of the fixed fabric belt 8 away from the fixed sleeve 9, one end of the adjustment band 16 is provided with a male buckle 15, the outer wall of the support fabric bag 6 is sewn with a fixed band 18, and one end of the fixed band 18 is sewn with a female buckle 17, by the cooperation of the female buckle 17 and the male buckle 15, the support rod 7 is locked twice to further prevent the support rod 7 from moving and ensure the stability thereof.

The middle of the secondary braces 4 is sewn and fixed on the main braces 3, the top of the secondary braces 4 is sewn with the fixed fabric belt 8, a triangular connection cloth 101 is sewn on both sides of the bottom of the backpack main body 1 the bottom end of the secondary braces 4 is sewn with the triangular connection cloth 101, and the hanging sleeve 11 is sewn with the triangular connection cloth 101, and through the triangular connection cloth 101 to carry out the connection of the secondary braces 4 and the hanging sleeve 11, to ensure the beautiful and stable connection.

A first strap 301 and a second strap 302 are sewn on the main braces 3 outside the secondary braces 4, and the first strap 301 is arranged above the second strap 302, by wrapping the upper half of the secondary braces 4 in the first strap 301 and the second strap 302, the secondary braces 4 is prevented from being separated from the main braces 3, and the secondary braces 4 is prevented from moving left and right, when the secondary braces 4 is stressed, the force is transmitted to the main braces 3, and the force is buffered by the buffer sponge layer on the main braces 3, which reduces the pressure on the shoulders and improves the comfort of carrying.

The secondary braces 4 outside the elastic band 5 is sleeved with an elastic girdle 401, which is which is used for the neat and beautiful appearance of the elastic band 5 and the secondary braces 4, the distance from seam part of the secondary braces 4 and the elastic band 5 to the bottom of the secondary braces is greater than the length of the elastic band 5, which ensured that the elastic band 5 has a stretch margin, thereby preventing the elastic band 5 from being too long, causing only the secondary braces 4 to be stressed and losing the function of elastic shock absorption.

A fixed female buckle 601 is provided on top outer wall of the support fabric bag 6, and a fixed male buckle 801 matched with the fixed female buckle 601 is provided on one side of the bottom of the fixed fabric belt 8, by the cooperation of the fixed female buckle 601 and the fixed male buckle 801, the support rod is locked to further prevent the support rod 7 from moving and ensure the stability thereof.

The support rod 7 comprises: two rod bodies 701, a double-ended sleeve 703 is arranged between the two rod bodies 701, the rod bodies 701 are hollow rods, an elastic string 704 is inserted through each of the rod bodies 701, by the arrangement of the double-ended sleeve 703 and the elastic string 704, the support rod 7 can be folded, and when the backpack is transported, the support rod 7 is removed to facilitate the folding and transportation of the backpack, and pulling out the rod bodies 701 to realize the folding of the support rod 7, which is convenient for saving space.

Both ends of the elastic string 704 are provided with spacing knots on the outside of the end of the rod body 701, and one end of the rod body 701 away from the double-ended sleeve 703 is provided with a plug 702, and the top of the plug 702 has a spherical transition, which is easy to fit in the fixed sleeve 9.

The rod bodies 701 are made of carbon fiber, which ensures the light weight of the rod body 701 and the supporting strength.

The buckle 10 is tri-glide buckle, an opening for hanging the hanging sleeve 11 is provided on one side of the buckle 10 close to the hanging sleeve 11, which is convenient for hanging and taking off the buckle 10, the corners of the buckle 10 are rounded to prevent the edge of the buckle 10 from causing wear and damage to the hanging sleeve 11 and the elastic band 5.

The bottom end of the elastic braces 14 and the bottom end of the support fabric bag 6 are sewn together with the bottom side of the backpack main body 1, thereby the elastic braces 14 can transmit the force to the support rod 7 in the support fabric bag 6, thereby the backpack is concentrated and the support performance of the backpack is improved.

The operating principle of the invention: when the two-way adjustable shock-absorbing backpack is used, the elastic stroke of the elastic braces 14 is limited by the length of the secondary braces 4, when the backpack is in static state, the elastic braces 14 and the main braces 3 are under force, and the upper half of the secondary braces 4 is in a free and unstressed state, when the backpack is in dynamic state, the elastic braces 14 are stretched and stretched until the secondary straps 4 are stressed, and the backpack is supported by the force of the secondary braces 4 and the main braces 3, by adjusting the length of the secondary braces 4 on the upper adjustment button 13, the length of the upper half of the secondary braces 4 can be adjusted, thereby the elastic stroke of the elastic braces 14 can be adjusted, when the length of the upper half of the secondary braces 4 becomes longer, the elastic deformation of the elastic braces 14 is large, and the shock absorption amplitude is large, whereas, when the length of the upper half of the secondary braces 4 becomes shorter, the elastic deformation of the elastic braces 14 is small, and the shock absorption amplitude is small, and above realizes the shock absorption adjustment of the top of the backpack.

When it is necessary to adjust the shock absorption of the bottom of the backpack, hanging the buckle 10 on the hanging sleeve 11, the elastic band 5 is stressed to support the backpack, and the elastic deformation of the elastic band 5 absorbs the shock of the backpack, by adjusting the lower adjustment button 12, the length of the lower half of the secondary braces 4 is adjusted to limit the amount of elastic deformation of the elastic band 5, when the elastic band 5 is deformed to the point where the secondary braces 4 is stressed, the deformation stops, thereby realizing the shock-absorbing stroke adjustment of the elastic band 5, and realizing the shock-absorbing adjustment of the bottom of the backpack.

By arranging support fabric bag, support rod and fixed fabric belt 8, the invention realizes that when the two-way adjustable shock-absorbing backpack is used, by inserting the support rod 7 into the support fabric bag 6, the end of the support rod 7 is covered by the fixed sleeve 9 on the fixed fabric belt 8, and the fixed fabric belt 8 is locked by the cooperation of the fixed female buckle 601 and the fixed male buckle 801, thereby realizing the fixing of the support rod 7, the support rod 7 is locked twice by the cooperation of the female buckle 17 and the male buckle 15, and the back of the backpack is supported by the support rod 7 to prevent the backpack from bending during the carrying process, to make the backpack fits the back and realize the vertical shock-absorbing of the backpack, which has a good shock absorption effect, and can avoid the collision between the backpack and the human body, thereby improving the comfort of the backpack.

Based on the embodiments in the invention, all other embodiments obtained by those skilled in the art without creative labor fall within the scope of protection of the invention.

The invention claimed is:

1. A two-way adjustable shock-absorbing backpack, comprising a backpack main body (1) and back pads (2) arranged on one side of the backpack main body (1), wherein the back pads are provided two, and the two are symmetrically arranged on the backpack main body (1), a back pad pocket with a top opening is formed between a back pad (2) and the backpack main body (1), a support fabric bag (6) is sewn into the back pad pocket, and a support rod (7) is inserted into the inside of the support fabric bag (6), one side of the backpack main body (1) above the support fabric bag (6) is provided with a fixed fabric belt (8), a fixed sleeve (9) for accommodating the top end of the support rod (7) is sewn on the bottom of the fixed fabric belt (8), and an elastic brace (14) is sewn on the bottom end of the support fabric bag (6) on the backpack main body (1), one end of the elastic brace (14) is sewn with a main brace (3), one end of the main brace (3) is sewn with a secondary brace (4), the upper half of the secondary brace (4) is provided with an upper adjustment button (13), and the lower half thereof is provided with a lower adjustment button (12), one side of the secondary brace (4) under the lower adjustment button (12) is sewn with an elastic band (5), one end of the elastic band (5) is sewn with a buckle (10), and a hanging sleeve (11) is sewn on both sides of the bottom of the backpack main body (1).

2. The two-way adjustable shock-absorbing backpack of claim 1, wherein an adjustment band (16) is provided on one side of the fixed fabric belt (8) away from the fixed sleeve (9), one end of the adjustment band (16) is provided with a male buckle (15), an outer wall of the support fabric bag (6) is sewn with a fixed band (18), and one end of the fixed band (18) is sewn with a female buckle (17).

3. The two-way adjustable shock-absorbing backpack of claim 1, wherein a middle of the secondary brace (4) is sewn and fixed on the main brace (0.3), a top of the secondary brace (4) is sewn with the fixed fabric belt (8), a triangular connection cloth (101) is sewn on both sides of a bottom of the backpack main body (1), a bottom end of the secondary brace (4) is sewn with the triangular connection cloth (101), and the hanging sleeve (11) is sewn with the triangular connection cloth (101).

4. The two-way adjustable shock-absorbing backpack of claim 1, wherein a first strap (301) and a second strap (302) are sewn on the main brace (3) outside the secondary brace (4), and the first strap (301) is arranged above the second strap (302).

5. The two-way adjustable shock-absorbing backpack of claim 1, the secondary brace (4) outside the elastic band (5) is sleeved with an elastic girdle (401), the distance from seam part of the secondary braces (4) and the elastic band (5) to the bottom of the secondary braces (4) is greater than the length of the elastic band (5).

6. The two-way adjustable shock-absorbing backpack of claim 1, wherein a fixed female buckle (601) is provided on top outer wall of the support fabric bag (6), and a fixed male buckle (801) matched with the fixed female buckle (601) is provided on one side of a bottom of the fixed fabric belt (8).

7. The two-way adjustable shock-absorbing backpack of claim 1, the support rod (7) comprises: two rod bodies (701), a double-ended sleeve (703) is arranged between the two rod bodies (701), the rod bodies (701) are hollow rods, an elastic string (704) is inserted through each of the rod bodies (701), and both ends of the elastic string (704) are provided with spacing knots on the outside of the end of the rod body (701), and one end of the rod body (701) away from the double-ended sleeve (703) is provided with a plug (702), and the top of the plug (702) has a spherical transition.

8. The two-way adjustable shock-absorbing backpack of claim 7, wherein the rod bodies (701) are made of carbon fiber.

9. The two-way adjustable shock-absorbing backpack of claim 1, wherein the buckle (10) is tri-glide buckle, an opening for hanging the hanging sleeve (11) is provided on one side of the buckle (10) close to the hanging sleeve (11), the corners of the buckle (10) are rounded.

10. The two-way adjustable shock-absorbing backpack of claim 1, wherein the bottom end of the elastic braces (14) and the bottom end of the support fabric bag (6) are sewn together with the bottom side of the backpack main body (1).

* * * * *